US008613177B2

(12) United States Patent
Pili

(10) Patent No.: US 8,613,177 B2
(45) Date of Patent: Dec. 24, 2013

(54) SELF-MOUNTING MODULAR STRUCTURE, FOR CONSTITUTING PROTECTED ENVIRONMENTS

(76) Inventor: Tiziano Pili, Albate (IT)

( * ) Notice: Subject to any disclaimer, the term of this patent is extended or adjusted under 35 U.S.C. 154(b) by 0 days.

(21) Appl. No.: 13/580,680

(22) PCT Filed: Feb. 14, 2011

(86) PCT No.: PCT/EP2011/000673

§ 371 (c)(1),
(2), (4) Date: Aug. 23, 2012

(87) PCT Pub. No.: WO2011/103967

PCT Pub. Date: Sep. 1, 2011

(65) Prior Publication Data

US 2012/0311954 A1 Dec. 13, 2012

(30) Foreign Application Priority Data

Feb. 24, 2010 (IT) ..... CO2010A0008

(51) Int. Cl.

| | |
|---|---|
| ***E04H 6/04*** | (2006.01) |
| ***E04H 15/44*** | (2006.01) |
| ***E04H 15/46*** | (2006.01) |
| ***E04H 15/48*** | (2006.01) |

(52) U.S. Cl.

USPC ..... 52/646; 52/645; 52/222; 135/128; 135/147; 135/141; 135/120.3

(58) Field of Classification Search

USPC ..... 52/646, 645, 222; 135/131, 145, 147, 135/151, 128, 129, 130, 120.3, 141

See application file for complete search history.

(56) References Cited

U.S. PATENT DOCUMENTS

| | | | | | |
|---|---|---|---|---|---|
| 644,737 | A | * | 3/1900 | Fry | 135/147 |
| RE26,215 | E | * | 5/1967 | Usher et al. | 52/646 |
| RE26,354 | E | * | 2/1968 | Usher et al. | 52/646 |
| 4,641,676 | A | * | 2/1987 | Lynch | 135/145 |
| 5,274,980 | A | * | 1/1994 | Zeigler | 52/646 |
| 5,327,700 | A | * | 7/1994 | Sorenson et al. | 52/109 |
| 5,632,292 | A | * | 5/1997 | Carter | 135/145 |
| 5,794,640 | A | * | 8/1998 | Jang | 135/131 |
| 5,813,425 | A | * | 9/1998 | Carter | 135/145 |
| 5,921,260 | A | * | 7/1999 | Carter | 135/145 |
| 6,000,175 | A | * | 12/1999 | Gale et al. | 52/63 |
| 6,021,795 | A | * | 2/2000 | Long et al. | 135/98 |
| 6,041,800 | A | * | 3/2000 | Carter | 135/145 |
| 6,138,702 | A | * | 10/2000 | Carter | 135/145 |
| 6,148,835 | A | * | 11/2000 | Rhee | 135/145 |
| 6,173,726 | B1 | * | 1/2001 | Talmadge | 135/144 |

(Continued)

*Primary Examiner* — Phi A
(74) *Attorney, Agent, or Firm* — Abelman, Frayne & Schwab

(57) ABSTRACT

A self-mounting modular structure comprises profiled peripheral columns (1, T) which exhibit upper overlapped and spaced fulcrums (2, 2'), wherein the rear portions of two series of crosspieces (3, 3') engage, the front ends whereof connect to upper (4) and lower (41) fulcrums of the central support rack (5) of a control unit (6) the stem whereof (7) connects, through a coaxial joint (8) and movable radial levers (9), to the front extensions (3") of the lower crosspieces (31). In feedback, the stem (7) rises and pushes the columns (1, T) outwards, which move on standard or roller tracked wheels (11), causing the lifting in the middle and "at the ceiling" of the crosspieces (3, 3'), located within the same columns. Peripheral section bars (19), also comprised in closure in the peripheral columns (1, T), delimit the structure with roll-up sheets (21), along with an upper cover (22) engaged, in the middle, with said rack (5).

8 Claims, 5 Drawing Sheets

(56) References Cited

U.S. PATENT DOCUMENTS

Figure 1A:
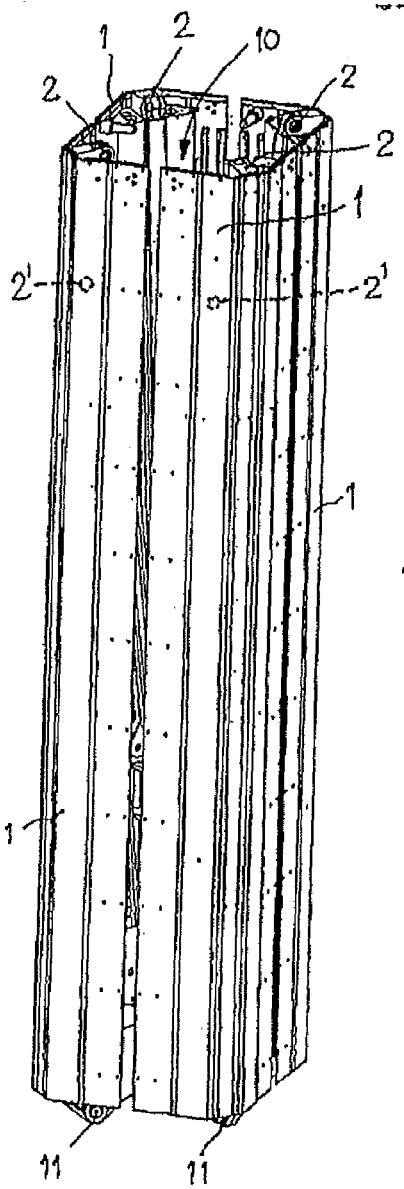

| | | | | |
|---|---|---|---|---|
| 6,206,020 | B1 * | 3/2001 | Lynch | 135/128 |
| 6,374,843 | B1 * | 4/2002 | Zou | 135/145 |
| 6,708,707 | B2 * | 3/2004 | Dotterweich et al. | 135/131 |
| 6,718,995 | B2 * | 4/2004 | Dotterweich | 135/131 |
| 6,725,873 | B2 * | 4/2004 | Liu | 135/145 |
| 6,929,017 | B2 * | 8/2005 | Byun | 135/145 |
| 7,422,026 | B2 * | 9/2008 | Kim | 135/131 |
| 7,556,054 | B2 * | 7/2009 | Zeigler | 135/145 |
| 7,628,165 | B2 * | 12/2009 | Rothweil | 135/135 |
| 7,832,170 | B2 * | 11/2010 | Zeigler | 52/646 |
| 8,220,477 | B2 * | 7/2012 | Park | 135/145 |
| 2001/0027417 | A1 | 10/2001 | Sato | |
| 2002/0059948 | A1 * | 5/2002 | Carter | 135/121 |
| 2002/0074032 | A1 | 6/2002 | Park | |
| 2003/0172966 | A1 * | 9/2003 | Dotterweich et al. | 135/131 |
| 2005/0055892 | A1 | 3/2005 | Tsai | |
| 2007/0057604 | A1 | 3/2007 | Aromin | |
| 2009/0151763 | A1 | 6/2009 | Stehly | |
| 2010/0139729 | A1 * | 6/2010 | Carter | 135/145 |
| 2010/0317498 | A1 * | 12/2010 | Mallookis et al. | 482/148 |
| 2010/0326004 | A1 * | 12/2010 | Daas et al. | 52/646 |
| 2012/0285500 | A1 * | 11/2012 | Mallookis et al. | 135/145 |
| 2012/0311954 | A1 * | 12/2012 | Pili | 52/646 |

* cited by examiner

SELF-MOUNTING MODULAR STRUCTURE, FOR CONSTITUTING PROTECTED ENVIRONMENTS

The invention relates to a self-mounting modular structure for constituting protected environments, especially suitable for making delimited areas such as boxes, exhibition stands, curtains, gazebos or for making environments and/or living spaces for temporary use in building yards and/or in areas affected by natural calamities, due to which the populations affected must be aided, evacuated and gathered in relief centres to be set up and organised in short times.

It is known that the current quick intervention techniques, especially for those related to natural calamities are based on the setup of tent camps and/or emergency shelters to be set up in protected areas as far as possible from the affected territories.

It is also known that even in non hazardous conditions, such as for example markets, fairs, and exhibitions in general, the spaces authorised for the exhibition and/or the sale of products are always delimited and are used for the setup of awnings, the positioning of motor vehicles with side curtains supported by bars and pickets, the assembly of prefabricated huts, the arrangement of stalls with sunshades and other corresponding or similar means, to be transported, assembled and disassembled in predetermined places.

In any case, although useful for the commercial purposes of daily use and/or for the emergency safety purposes for hazardous events in general, the means currently available are not functional and rationale, are not comfortable to use, require much time for the setup, for preparing the sites to use, for the subsequent dismantling, for storing the materials to use and store, and last but not least, for the need of a large physical presence of skilled personnel available to work manually, hardly and quickly, even in critical conditions.

The object of this invention is to eliminate the above drawbacks by a self-mounting modular structure for constituting delimited and protected environments characterised according to what claimed in the first claim. Further features are defined in the dependent claims.

The advantages achieved by the present invention essentially consist in that said modular structure consists of a series of devices, preassembled and already steadily combined with one another, arranged for allowing without difficulties, the quick and automatic assembly or dismantling thereof, through the action of a single operator working with manual, semiautomatic or automatic means.

The self-mounting modular structure for constituting protected environments, according to the invention, consists of profiled peripheral bearing columns, wherein between the following are arranged:

- extractable upper crosspieces, centrally and peripherally supported, for constituting and stabilising the bearing structure and supporting a cover sheet,
- upper peripheral section bars for completing the structural stability and containing peripheral roll-up sheets constituting the walls,
- standard or adjustable lower tracked wheels for in line setup, with adjustment means according to the planar irregularities of the supporting grounds,
- a mechanical, electro-mechanical or oil-pressure control unit, with manual, electrical or remotely controlled drive, for opening and closing the structure as a whole, according to the arrangement of the crosspieces and of the upper peripheral section bars.

Figure 1B:
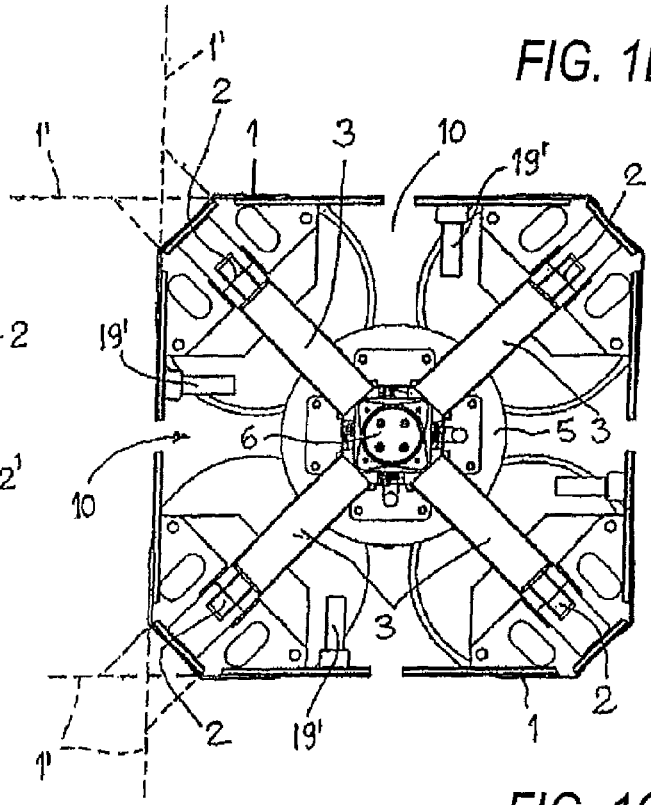
Figure 1C:
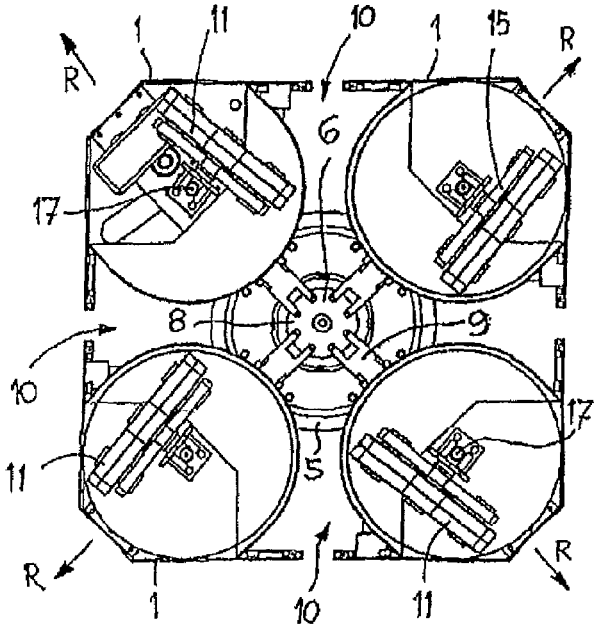
Figure 2:
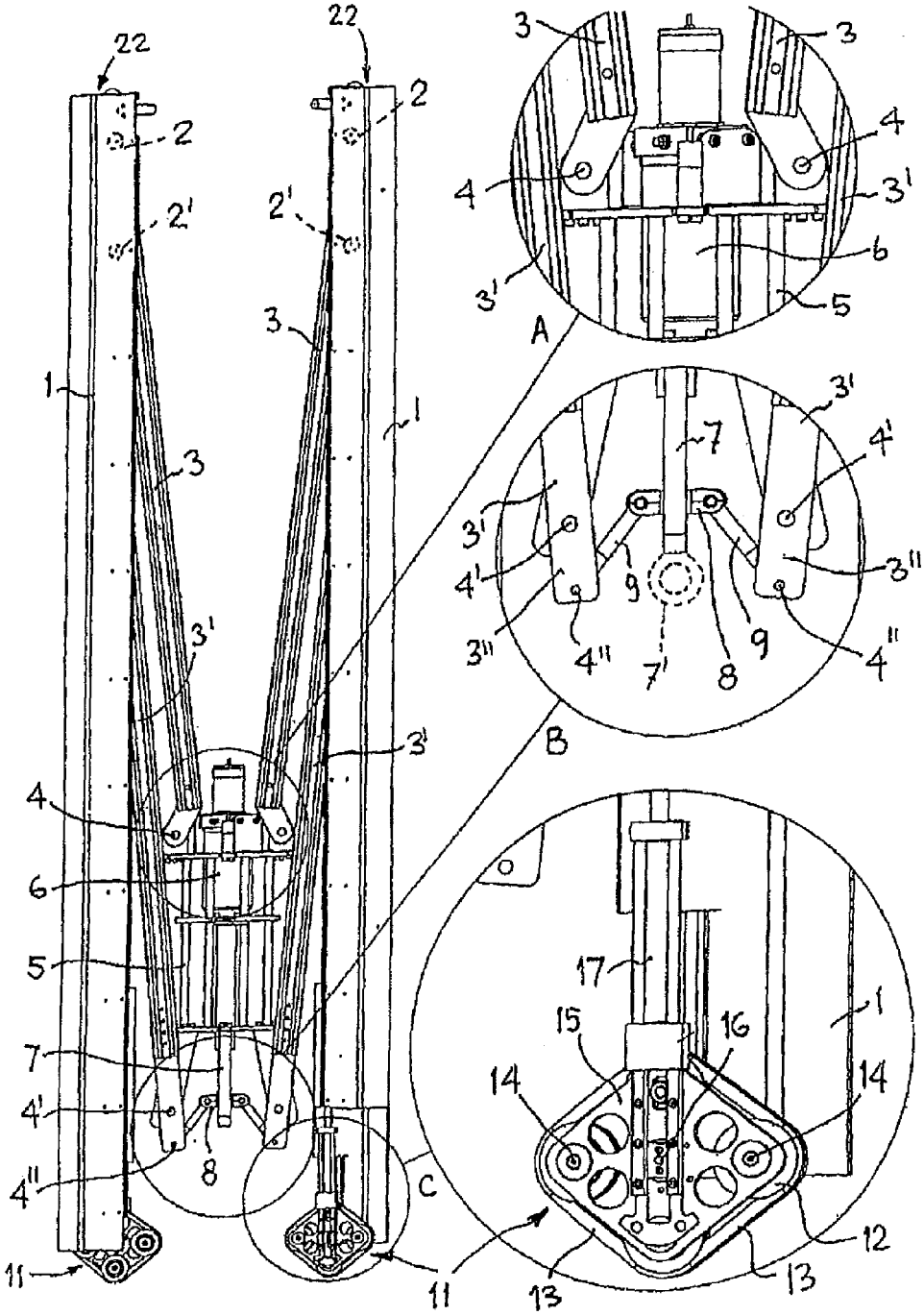
Figure 3:
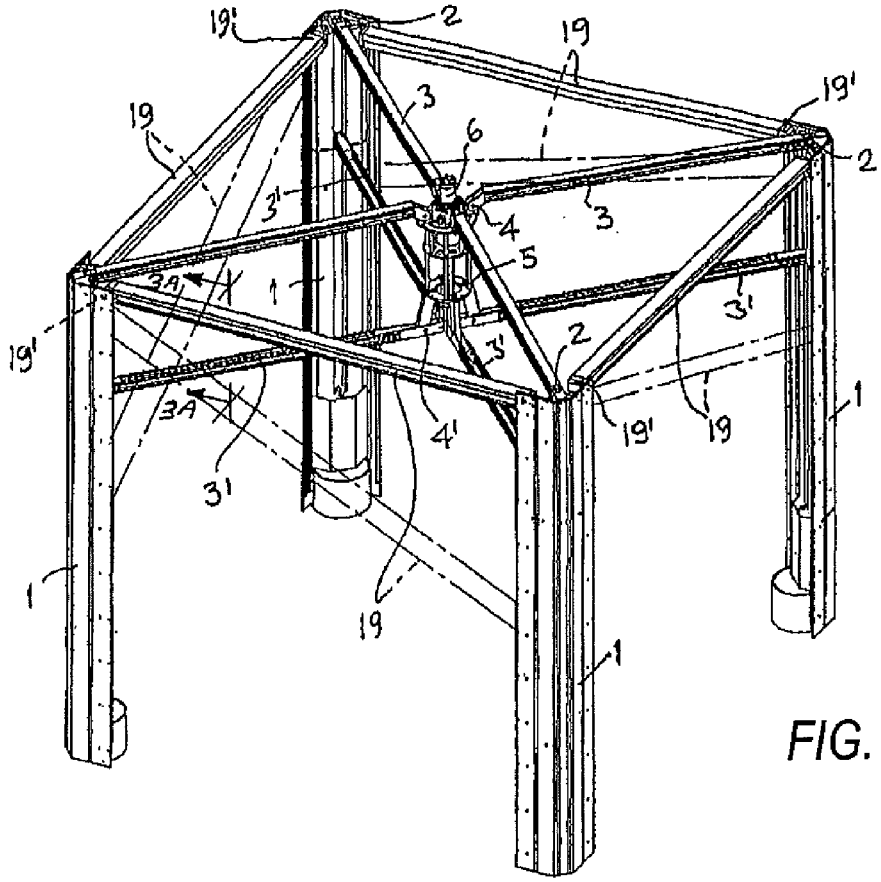
Figure 4:
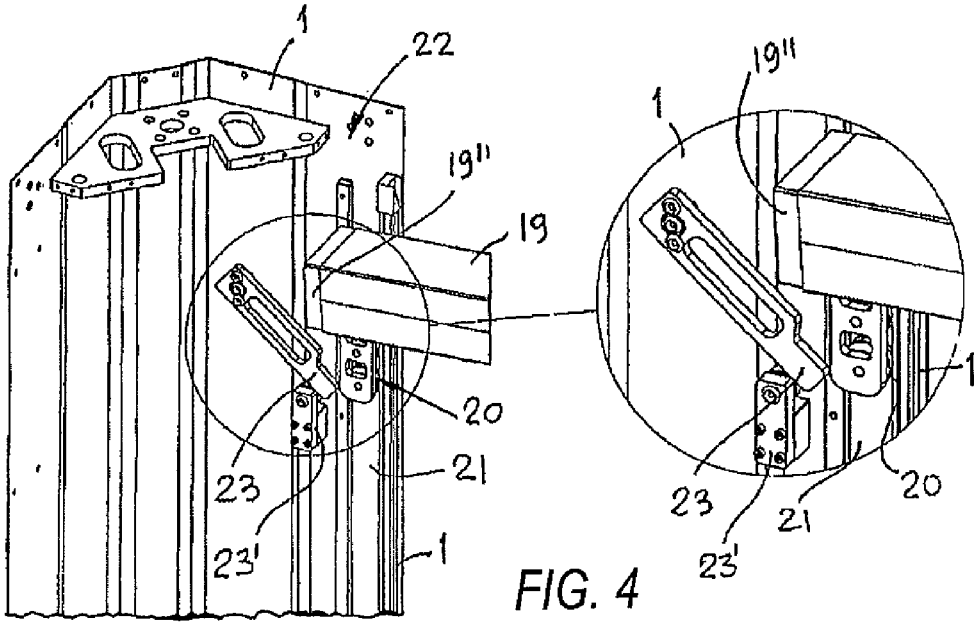
Figure 5:
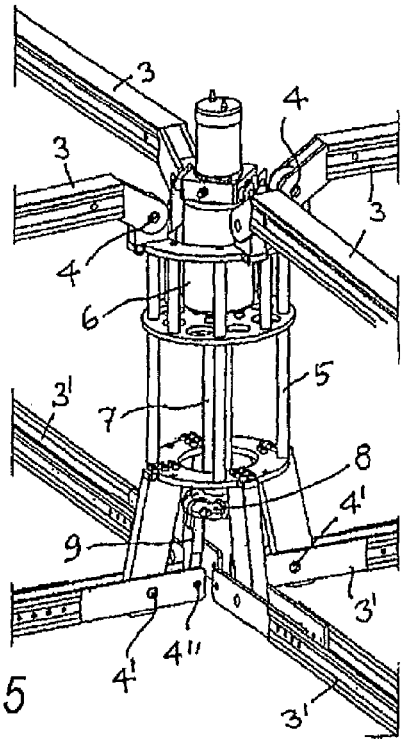
Figure 6:
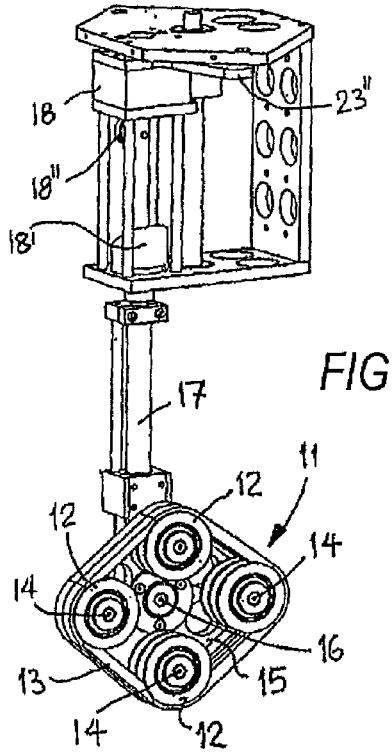
Figure 7:
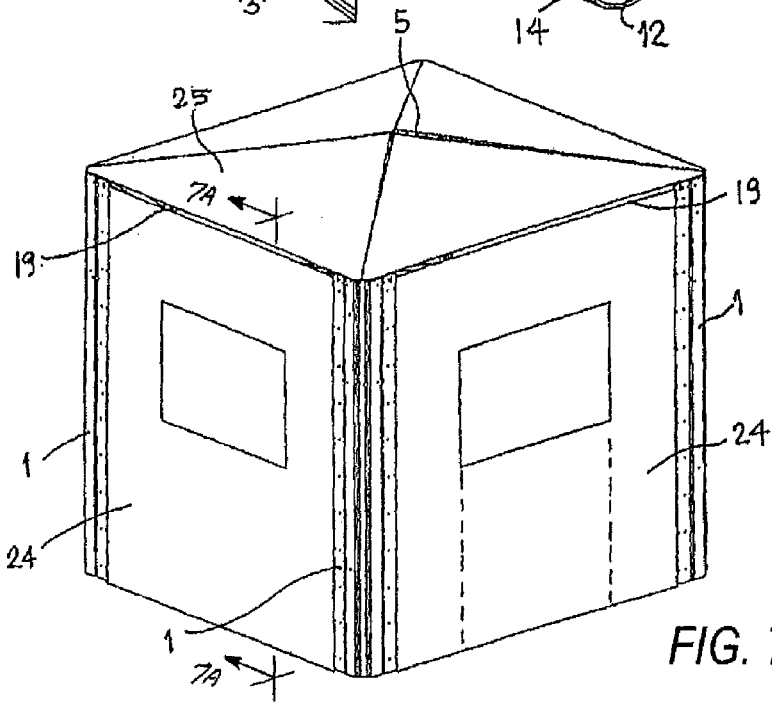
Figure 3A:
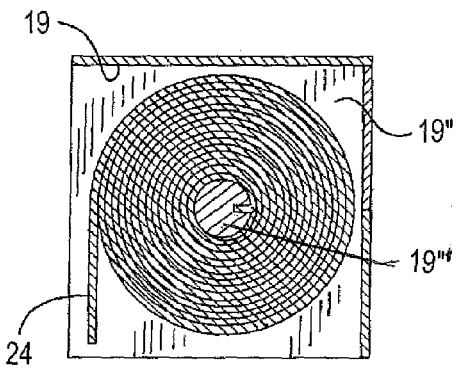
Figure 7A:
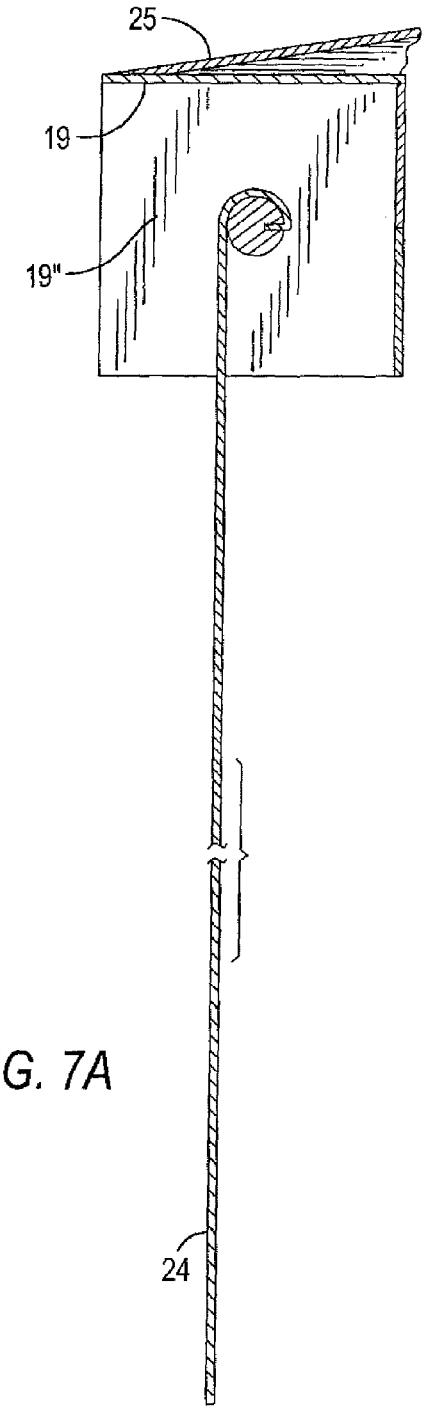

The invention is described in detail hereinafter, according to an embodiment with single module, given only by way of a non-limiting example, with reference to the attached drawings, wherein:

FIG. 1*a*, 1*b*, 1*c* show a self-mounting modular structure according to the invention, in the totally closed condition for transporting and/or laying and/or prior to assembly, in perspective view and enlarged, the same structure in a top and below plan view, FIG. 2 shows an example of a single self-mounting modular structure, seen from the side and in opening or closing step, with enlargements of the details: upper (A) and lower (B) of connection between the upper crosspieces and the central support rack for an opening/closing control unit, and (C) special tracked wheels with adjustable setup, FIG. 3 shows a perspective view of the same single self-mounting modular structure with the crosspieces in open position and the peripheral section bars in opening step (dotted) and in totally open position (uninterrupted line), FIG. 3*a* shows a cross-sectional view along line 3*a*-3*a* in FIG. 3, FIG. 4 shows an example of top hooking of the peripheral section bars, FIG. 5 shows the perspective view of the central opening/closing control unit and of the support rack thereof, with the connecting points of the front ends of the upper crosspieces, FIG. 6 shows the perspective view of one of the wheels of the "tracked" type with the position adjustment means according to the irregularities of the support grounds of the uprights, and FIG. 7 the perspective view of a single self-mounting modular structure totally set up, FIG. 7*a* shows a cross-sectional view along line 7*a*-7*a* in FIG. 7.

With reference to the above figures, a single self-mounting modular structure substantially consists of peripheral columns (1), generally with angular L section with same wings, which in closed condition prior to the setup at the centre are side by side, forming a "parallelepiped container" wherein the following items are composed, arranged and preassembled: the crosspieces and the section bars stabilising and delimiting the structural assembly, the relative coupling and positioning means, the standing members, the opening and closing control unit, the peripheral and top sheets delimiting the environment to be constituted.

In the top side, the columns (1) exhibit overlapped spaced fulcrums (2, 2') wherein the rear ends of two series of crosspieces (3, 3') engage, the front ends whereof connect to upper (4) and lower (4') fulcrums of the central support rack (5) of a control unit (6) comprising a movable extensible stem (7).

In turn, the stem (7) comprises a coaxial joint (8) on the periphery whereof there are radially pivoted the front ends of movable levers (9) which on the opposite side engage in fulcrums (4") provided on the front extensions (3") of said lower crosspieces (3').

In the closed condition of the modular structure, the stem (7) is totally extended downwards and the crosspieces (3, 3') are arranged vertically within the space (10) formed by the columns (1) side by side at the centre.

Upon the setup of the modular structure, for forming a protected environment, the stem (7) is returned upwards either by a control unit (6) (as shown), or by a crank lever that may be hooked to a lower eyebolt (7') of the same stem, pulling the radial levers (9) in the movement by means of the coaxial joint (8). In turn, the levers (9) return both the crosspieces (3'), engaged at the ends (3"), and the central rack (5) connected to the crosspieces (3') through the fulcrums (4'), upwards. The same rack (5), moved upwards, returns the upper crosspieces (3) too, which rotate around the fulcrums (4), to the same position. Such coordinated actions, besides causing the lifting in the middle and "at the ceiling" of the crosspieces (3, 3'), which project from the space (10), push the columns (1) outwards, in radial direction (R) relative to the rack (5), making it slide either directly on traditional wheels, for less expensive configurations or for applications on levelled and regular grounds, or on tracked wheels as illustrated (11); each of said tracked wheels consisting of a plurality of rollers (12) associated to one another through continuous chain tracks (13) and pivoting on pins (14) of a flange (15) which in turn can rotate about a central horizontal axis (16) comprised on a self-aligning bracket (17). Each bracket (17) is provided with means for the adjustment, vertical fixing and constraining into position, for example consisting of a motor reduction unit (18) and a cam (18') whereon a pawl (18") slides and positions. The configuration of said tracked wheels (11), with three, four or more rollers (12) allows a proper horizontal setup of the structure, irrespective of any changes in the level of the grounds whereon the positioning thereof is required.

Within the upper portion of the columns (1) there are also arranged the fulcrums (19') of the upper ends of section bars (19) the lower ends whereof engage sliding-wise, through rollers (20), into the vertical guides (21) provided along the adjacent columns (1). During the outwards spreading and the lifting at the middle and up to the "ceiling" of the crosspieces (3, 3'), the lower ends of the section bars (19) are also returned upwards, up to arranging and fixing horizontally between the upper ends (22) of said adjacent columns, and automatically constraining in place the sliding ends thereof (lower 19") by stops (23) which, at the end of the extension and upon the steady positioning of the columns (1) on the ground, with retraction of the wheels (11), are pushed upwards by sliding travel end pushers (23') connected to plates (23") associated to said brackets (17). In such open position, the section bars (19) are also arranged and engaged horizontally, between the upper ends (22) of the same columns (1) and at the same level as said upper crosspieces (3), contributing to both the general stability of the structure and to the final delimitation thereof, generated by sheets (24) that may be unwound, downwards and up to the ground, by the roll-ups comprised in the same section bars (19), sliding in special vertical guides, provided along the same columns.

The roll-up means, a rotatable shaft 19"; is shown in FIGS. 3*a* and 7*a* which show, respectively, the sheet 24 in its wound and unwound positions.

A cover (25), peripherally constrained to said section bars (19), and in the middle of said rack (5), totally covers the environment during the opening action.

The opening/closing control unit (6) of the structure may be made by mechanical means, such as: scroll/worm screw or gear/rack, with manual control with crank lever or with electromechanical control with motor reduction unit, or even with hydraulic piston with combined control unit (as indicated in the drawings by way of an example), also actuable by remote control.

Electrical sockets for lighting and auxiliary sockets for other useful utilities are provided on the columns (1), with power supply obtainable from the mains or batteries, with panel or remote control.

Two or more modular structures as described may be composed, placing them side by side to one another, for constituting larger environments; other possible solutions may be realised by the use of columns (1) set up with longitudinal profiled extensions (1') forming sections shaped as T or cross, as indicated by a dashed line in FIG. 1*b*.

The invention claimed is:

1. Self-mounting modular structure for constituting a protected environment, comprising:

a plurality of profiled peripheral bearing columns (1, 1') having overlapped spaced fulcrums (2, 2');

a plurality of crosspieces (3, 3') having a front and rear portions;

a control unit (6) for opening and closing the self-mounting modular structure and having a central support rack (5) provided with upper (4) and lower (4') fulcrums, and a stem (7) provided with a coaxial joint (8), wherein the rear ends of the crosspieces engage in the overlapped spaced fulcrums (2, 2') of the profiled peripheral bearing columns (1, 1'), and the front ends of the cross-pieces engage in the upper (4) and lower (4') fulcrums of the central support rack (5), wherein the self-mounting modular structure further comprises a plurality of levers (9) having front ends thereof radially pivoting on a periphery of the coaxial joint (8) of the stem (7) of the control unit (6), and having opposite ends thereof engaging in fulcrums (4") provided on front extensions (3") of lower crosspieces (3') of the plurality of crosspieces (3, 3'), wherein the self-mounting modular structure also comprises a plurality of peripheral sections bars (19) having upper ends thereof engaging in upper fulcrums (19') of the profiled peripheral bearing columns and low ends thereof slidingly engaging, through wheels (20), in vertical guides (21) provided along the profiled peripheral bearing columns (1, 1'), means for constraining the sliding engagement of the peripheral section bars (19) and including travel end pushes (23') and stops (23), and roll-up means (19'") provided in the peripheral section bars (19) for winding and unwinding peripheral sheets (24) delimiting the protected environment, and wherein and profiled peripheral bearing columns (1, 1") are provided with wheels (11) for insuring a proper horizontal setup of the structure.

2. Self-mounting modular structure according to claim 1, wherein the wheels each is formed of a plurality of rollers, and the wheels provide for lifting of the crosspieces (3, 3'), peripheral section bars (19), and the control unit written an inside space (10) of the peripheral columns (1, 1').

3. Self-mounting modular structure according to claim 1, further comprising a top cover (25) that peripherally engage the peripheral section bars (19) and centrally the support rack (5) of the control unit (6).

4. Self-mounting modular structure according to claim 3, wherein the peripheral columns (1, 11) form, in an initial, closed position thereof, a "parallelepiped container" including the preassembled and arranged the crosspieces (3, 3'), peripheral section bars (19), the wheels, the control unit (6), the roll-up means ( ) together with the environment delimiting streets (24) and top cover (25).

5. Self-mounting modular structure according to claim 1, wherein the peripheral columns (1, 1') have a generic L-shaped angular structure with equal wings.

6. Self-mounting modular structure according to claim 2, comprising a plurality of continuous chain tracks (13) which provide for association of the plurality of rollers (12) of respective wheels (11); a plurality of flanges (15) having pins (14) about which the plurality of rollers (12) of respective wheels pivot; a plurality of self-aligning brackets (17) defining respective horizontal axes (16) about which respective flanges (15) pivot, each bracket (17) being provided with vertical fixing and position constraining means including a motor reduction unit (18) a cam (18'), and pawl (18") positioned on the cam (18').

7. Self-mounting modular structure according to claim 2, wherein each wheel (11) has three, four, or more rollers (12).

8. Self-mounting modular structure according to claim 1, wherein some of the profiled columns (1') have longitudinal profiled extensions which provide for assembly of the self-mounting modular structure with at least one identical self-mounting structure.

* * * * *